US010141130B2

(12) United States Patent
Andic

(10) Patent No.: US 10,141,130 B2
(45) Date of Patent: Nov. 27, 2018

(54) LOCKING MECHANISM

(71) Applicant: Eaton Corporation, Cleveland, OH (US)

(72) Inventor: Milorad Andic, Ontario (CA)

(73) Assignee: Eaton Intelligent Power Limited, Dublin (IE)

( * ) Notice: Subject to any disclaimer, the term of this patent is extended or adjusted under 35 U.S.C. 154(b) by 254 days.

(21) Appl. No.: 15/138,249

(22) Filed: Apr. 26, 2016

(65) Prior Publication Data

US 2017/0125183 A1 May 4, 2017

Related U.S. Application Data

(60) Provisional application No. 62/248,583, filed on Oct. 30, 2015.

(51) Int. Cl.
*H01H 9/28* (2006.01)
*E05B 65/06* (2006.01)
*H01H 9/22* (2006.01)

(52) U.S. Cl.
CPC ..... *H01H 9/285* (2013.01); *E05B 65/06* (2013.01); *H01H 9/22* (2013.01)

(58) Field of Classification Search
CPC ..... H01H 9/285; H01H 9/28; H01H 9/045; H01H 27/06
USPC ..... 200/43.11, 43.16, 43.19, 50.12–50.14
See application file for complete search history.

(56) References Cited

U.S. PATENT DOCUMENTS 1,348,187 A * 8/1920 Saegesser ..... B60R 25/04 200/43.11
1,487,345 A * 3/1924 Lundstrom ..... H01H 9/104 200/50.13
1,730,233 A * 10/1929 Norviel ..... B60R 16/005 200/4
2,863,012 A * 12/1958 Hopkins ..... H01H 9/285 200/50.09
5,486,663 A 1/1996 Fritsch et al.
7,323,956 B1 1/2008 Puskar et al.
2008/0277249 A1* 11/2008 Zubieta ..... H01H 9/283 200/43.11

OTHER PUBLICATIONS

Trapped key interlocking, Wikipedia; available at https://en.wikipedia.org/w/index.php?title=Trapped_key_interlocking&oldid=681500141; last accessed Mar. 25, 2016.
Interlock Instruction Manual; Kirk Key Interlock Company; pp. 1-12.

* cited by examiner

*Primary Examiner* — Felix O Figueroa
(74) *Attorney, Agent, or Firm* — Benesch Friedlander Coplan & Aronoff LLP

(57) ABSTRACT

An apparatus includes a cabinet with a door. A circuit interrupting device is installed in the cabinet. A plate on the door is operative to shift the circuit interrupting device between ON and OFF conditions upon movement of the plate between ON and OFF positions. A handle on the door is linked with the plate to move the plate between the ON and OFF positions upon movement of the handle between corresponding positions. Additionally, a latch is supported the door for movement into and out of a locked position in which the latch blocks movement of the plate to the ON position. A driving member is moveable against the latch to move the latch into the locking position against the bias of a spring. A key moves the driving member against the latch.

20 Claims, 5 Drawing Sheets

LOCKING MECHANISM

RELATED APPLICATION

This application claims priority of provisional U.S. Patent Application 62/248,583, filed Oct. 30, 2015, which is incorporated by reference.

TECHNICAL FIELD

This technology relates to an electrical cabinet with a door-mounted switching device.

BACKGROUND

Electrical circuit switching devices, such as fusible switches or the like, may be installed in a cabinet configured to contain the switching devices. A door at the front of the cabinet provides access for installation and removal of the switching devices, as well as for manual switching of the devices between ON and OFF conditions. A handle on the outer side of the door is linked with the switching devices for an operator to switch them manually by moving the handle while the door is closed.

SUMMARY

An apparatus includes a cabinet with a door. A circuit interrupting device is installed in the cabinet. A plate on the door is configured to shift the circuit interrupting device between ON and OFF conditions upon movement of the plate between ON and OFF positions. A handle on the door is linked with the plate to move the plate between the ON and OFF positions upon movement of the handle between corresponding positions. Additionally, a latch is supported on the door for movement into and out of a locked position in which the latch blocks movement of the plate to the ON position. A driving member is moveable against the latch to move the latch into the locking position against the bias of a spring. A key moves the driving member against the latch.

DETAILED DESCRIPTION

Figure 1:
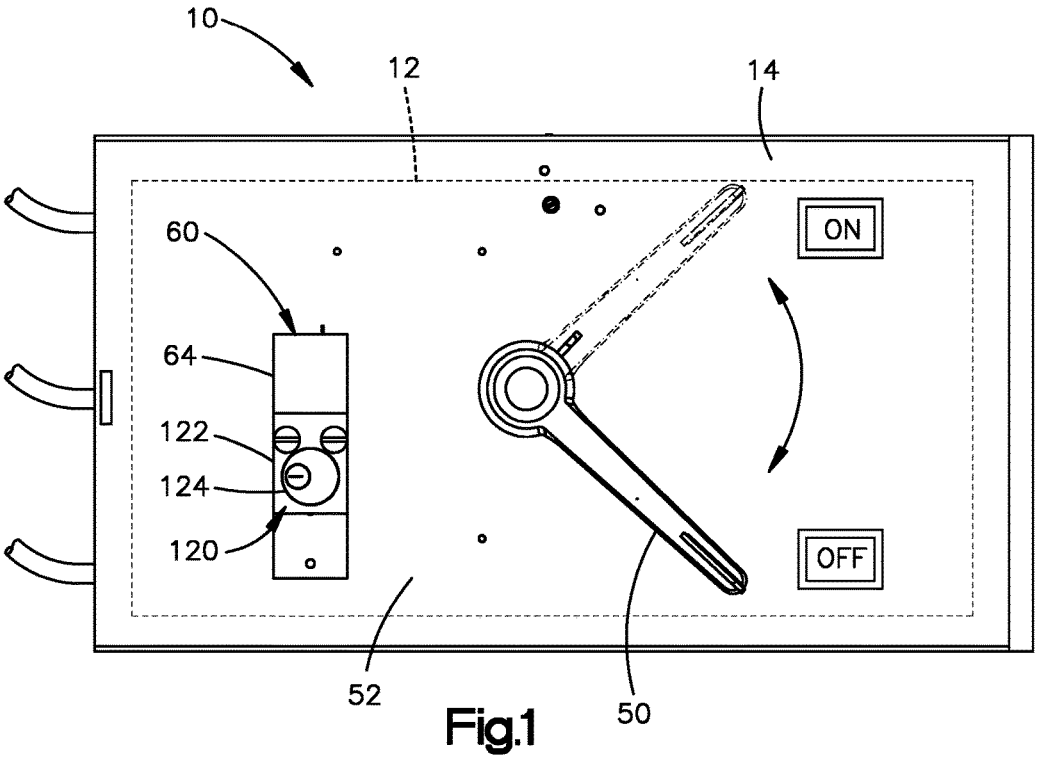
FIG. 1 is a front view of an apparatus including an electrical cabinet with a door and a locking mechanism.

The apparatus illustrated in the drawings includes parts that are examples of the elements recited in the claims. The illustrated apparatus thus includes examples of how a person of ordinary skill in the art can make and use the claimed invention. It is described here to meet the enablement and best mode requirements of the patent statute without imposing limitations that are not recited in the claims.

As shown schematically in FIG. 1, an electrical cabinet 10 may contain a circuit interrupting device 12. The circuit interrupting device 12, which may include fusible switches, can be switched between an ON condition and an OFF condition. A door 14 at the front of the cabinet 10 can be opened for installation and removal of the circuit interrupting device 12.

Figure 2A:
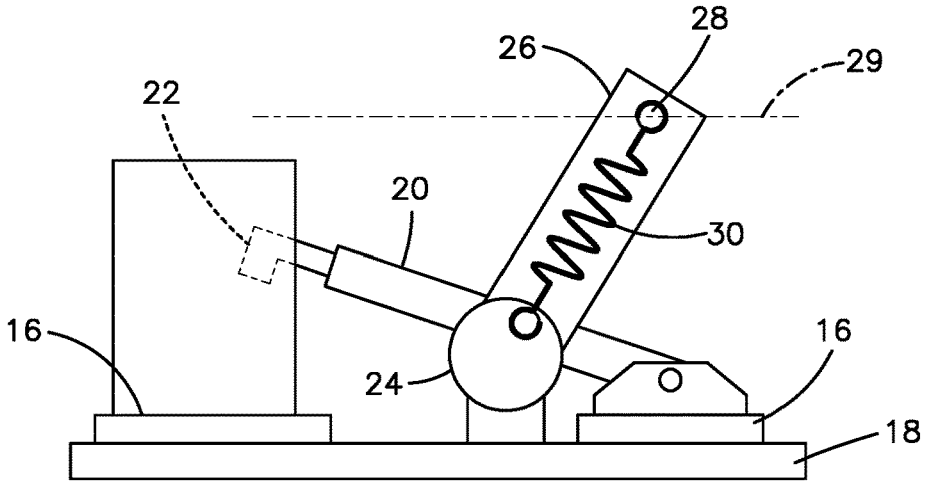
FIGS. 2A-2C are schematic views of parts of an electrical circuit interrupting device.
Figure 2B:
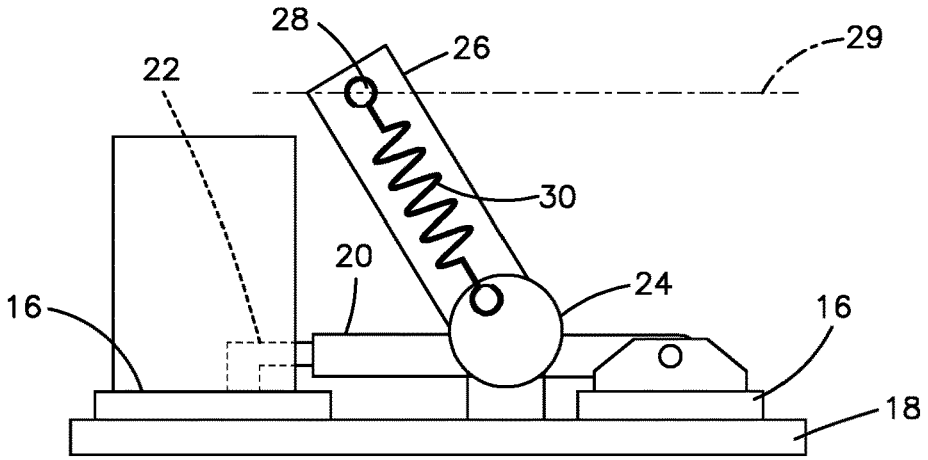
Figure 2C:
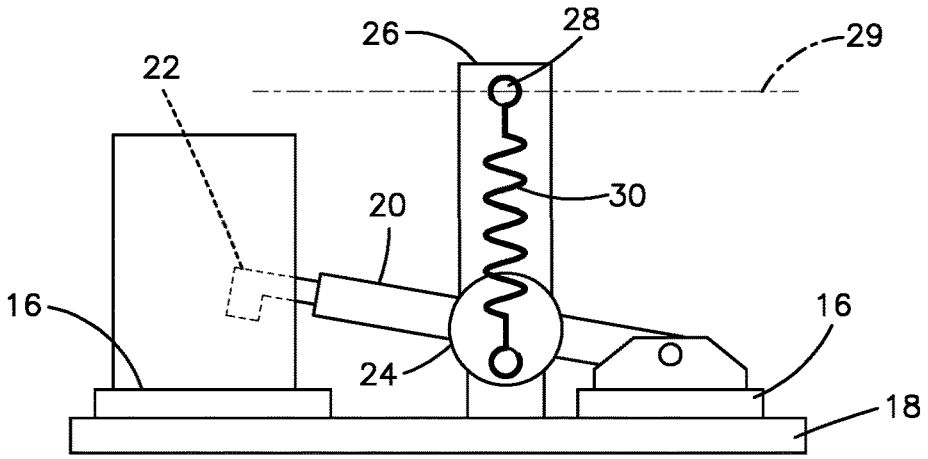

As shown schematically in FIGS. 2A-2C, the circuit interrupting device 12 in the illustrated example is a known device having a pair of electrically conductive base members 16 separated by an insulated substrate 18. An electrically conductive plate 20 is supported on one base member 16 for movement pivotally between the open position of FIG. 2A and the closed position of FIG. 2B. When the plate 20 is in the closed position of FIG. 2B, terminals 22 at the free end of the plate 20 make contact with the other base member 16 to complete a circuit between the base members 16.

A cam mechanism 24 links a lever 26 with the plate 20 to move the plate 20 pivotally between its open and closed positions upon movement of the lever 26 pivotally between corresponding open and closed positions, as shown in FIGS. 2A and 2B. When the lever 26 is moved back and forth between those positions, a pin 28 on the lever 26 moves back and forth along a straight line 29. As the lever 26 and pin 28 pivot in either direction toward the intermediate position shown in FIG. 2C, the cam mechanism 24 stretches an array of coil springs 30 acting between the pin 28 and the cam mechanism 24. This induces tension in the springs 30 to resist movement of the lever 26 pivotally out of its open or closed position, and to urge the lever 26 to move pivotally further toward the open or closed position upon moving past the intermediate position.

Figure 3:
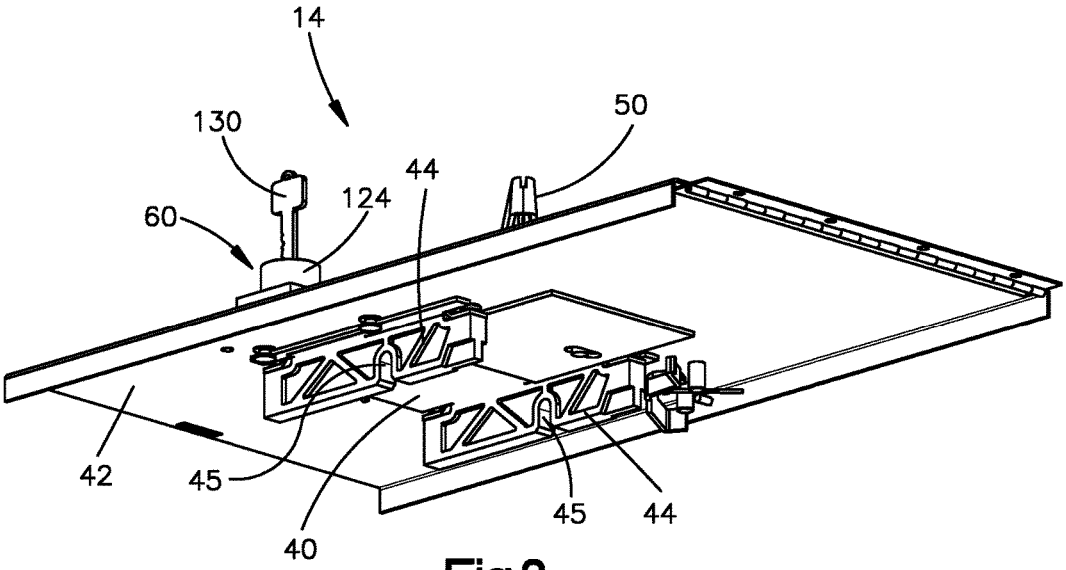
FIG. 3 is a perspective view, taken from below, of parts of the apparatus of FIG. 1.

A plate 40 (FIGS. 3 and 4) is supported on the inner side 42 of the door 14 for sliding movement back and forth between an OFF position an ON position. Elongated brackets 44 on the plate 40 move longitudinally back and forth with the plate 40. The brackets 44 have open-ended slots 45 that receive opposite ends of the pin 28 (FIGS. 2A-2C) when the door 14 is closed. The pin 28 then reaches across and between the brackets 44 and through the sots 45. In this arrangement the pin 28 is received in driven engagement by the brackets 44 so as to be moved back and forth along the line 29 shown in FIGS. 2A-2C upon longitudinal movement of the brackets 44 with the plate 40. The plate 40 is thus linked with the lever 26 to switch the circuit interrupting device 12 between its ON and OFF conditions upon corresponding movement of the lever 26.

A handle 50 is accessible at the outer side 52 of the door 14, and is supported on the door 14 for movement manually back and forth between an OFF position and an ON position. The handle 50 is linked with the plate 40 in a known manner so as to shift the plate 40 between the ON and OFF positions of the plate 40 upon movement of the handle 50 between the corresponding positions of the handle 50.

Also mounted on the door 14 is a locking mechanism 60. The locking mechanism 60 is shiftable between a locked condition and an unlocked condition. When the locking mechanism 60 is in the locked condition, it blocks movement of the plate 40 and the handle 50 to their ON positions. This prevents an operator from shifting the circuit interrupting device 12 into the ON condition inadvertently.

As shown in FIGS. 5-9, the locking mechanism 60 in the given example includes a base plate 62 and a housing 64. This example of a base plate 62 has an elongated rectangular shape with a slot 65 reaching longitudinally along one end portion 66. The slot 65 in the base plate 62 is aligned with an aperture 67 (FIG. 4) in the door 14.

This example of a housing 64 is shaped as a rectangular block, and is mounted on the slotted end portion 66 of the base plate 62 by fasteners (not shown). The housing 64 has a front side 70 with a circular opening 71. A cylindrical bore 73 reaches inward from the circular opening 71 along a first axis 75. A generally rectangular compartment 77 (FIG. 6) reaches upward from a lower side 78 of the housing 64. A shaft 80 reaches across the compartment 77 along a second axis 81 orthogonal to the first axis 75.

Figure 5:
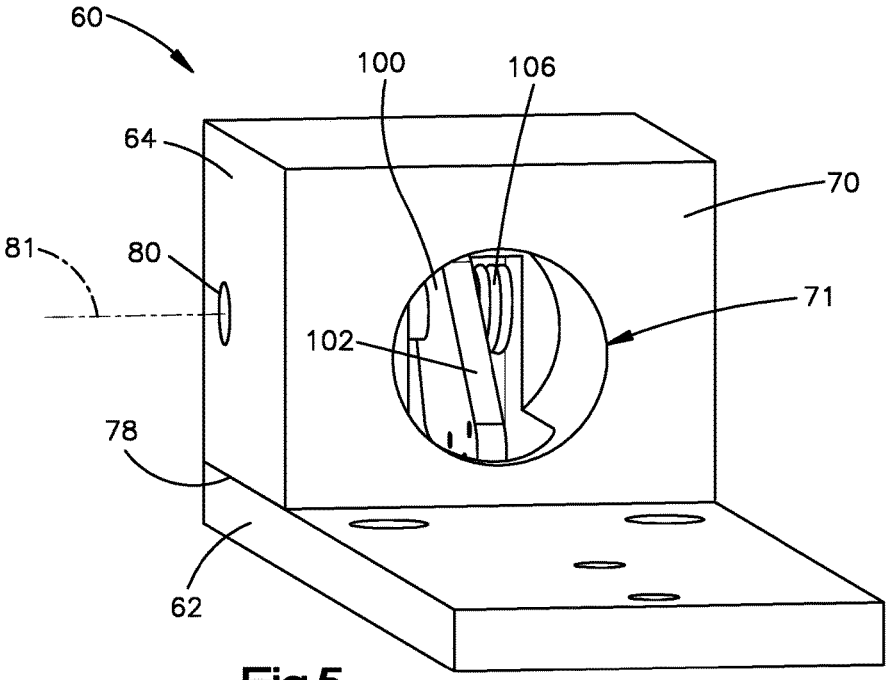
FIG. 5 is a front perspective view of parts of the locking mechanism of FIG. 1.
Figure 6:
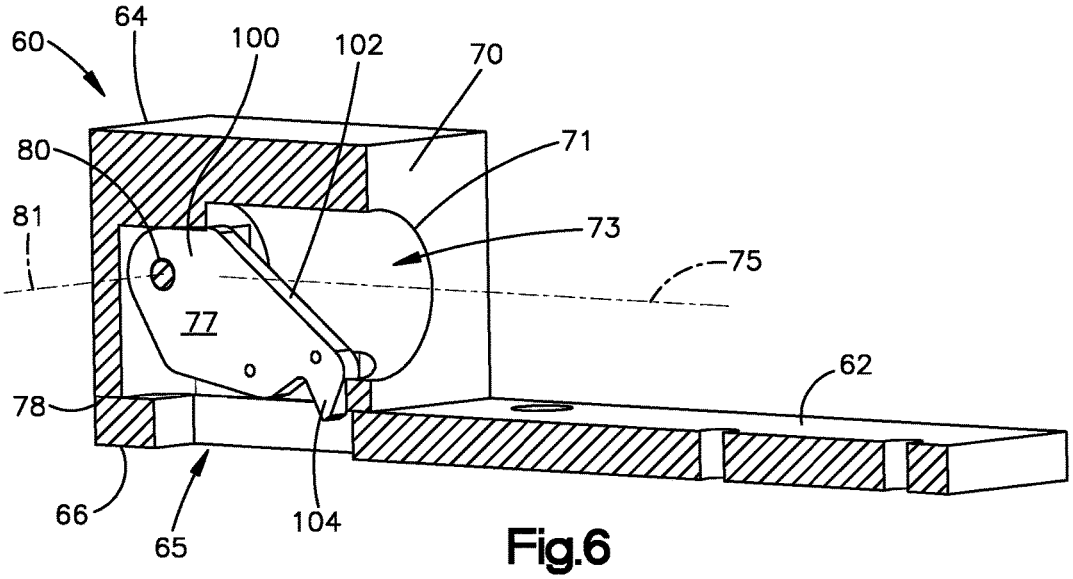
FIG. 6 is a view similar to FIG. 5, partly in section.
Figure 7:
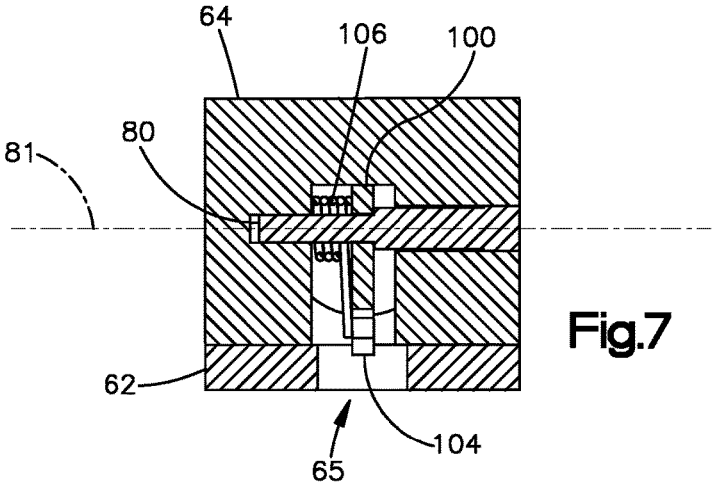
FIG. 7 is a sectional view of parts shown in FIG. 5.
Figure 8:
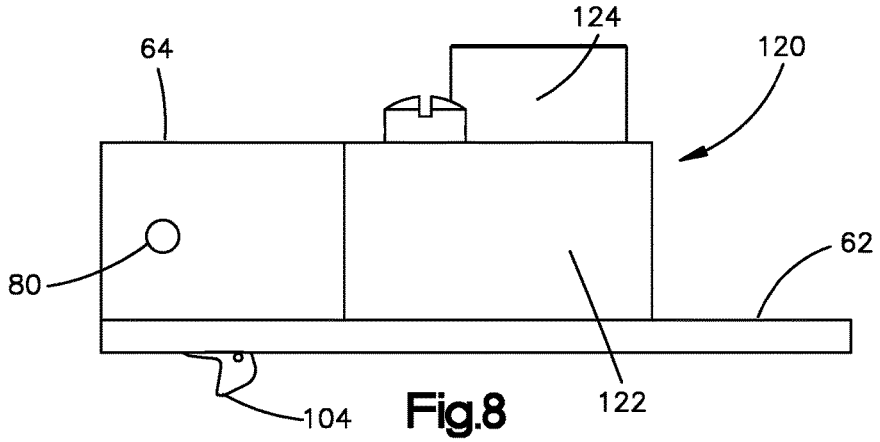
FIG. 8 is a side view of the locking mechanism of FIG. 1.

A latch 100 is mounted on the shaft 80 for rotation about the second axis 81 relative to the housing 64. The latch 100 in the given example is a plate with an inclined forward edge surface 102 facing outward through the bore 73 and the circular opening 71. A lower end portion 104 of the latch 100 is aligned with the slot 65 in the base plate 62. A spring 106 is engaged between the latch 100 and the housing 64 to bias the latch 100 about the second axis 81 such that the latch 100 is normally held in an unlocked position. When the latch 100 is in the unlocked position, as shown in FIGS. 5 and 6, the lower end portion 104 does not project outward through the slot 65 in the base plate 62.

Also fastened to the base plate 62 is a device known as an interlock 120. The interlock 120 includes a lock body 122, a lock cylinder 124, and a lock bolt 126 that is moved back and forth between retracted and extended positions by turning a key 130 in the cylinder 124. The lock bolt 126 is aligned with the circular opening 71 so as to move into and out of the bore 73 in the housing 64.

Figure 4:
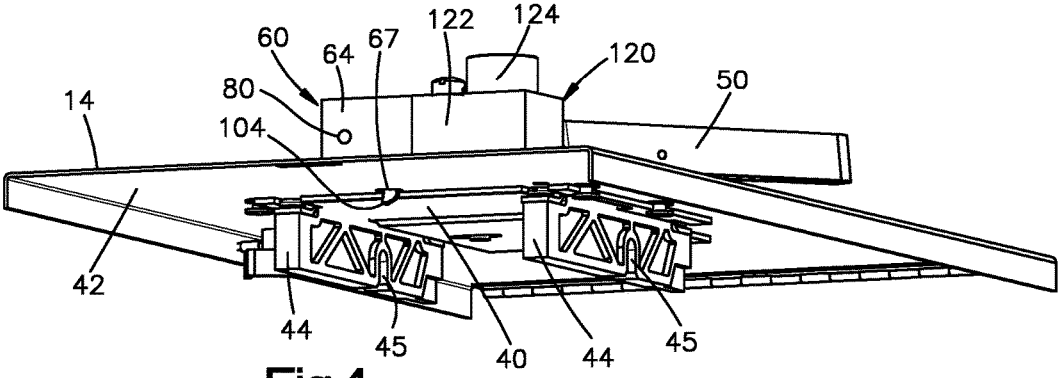
FIG. 4 is an alternate perspective view of parts shown in FIG. 3.
Figure 9:
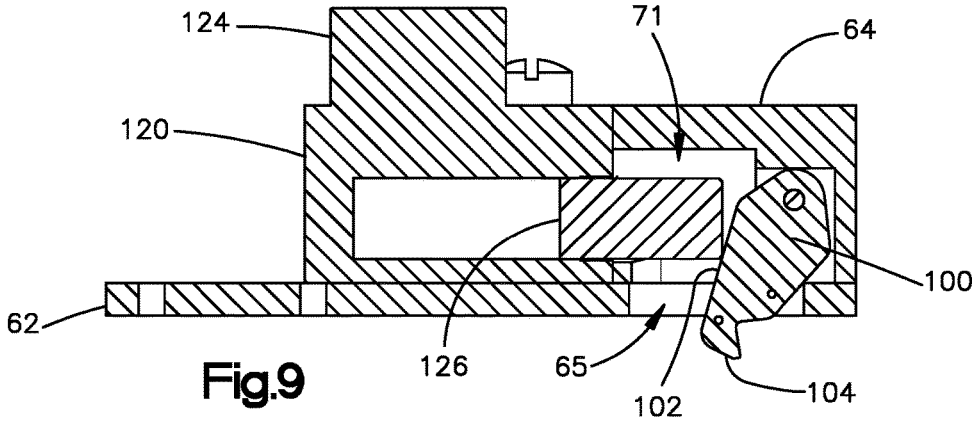
FIG. 9 is a sectional view of the parts shown in FIG. 8.
Figure 10:
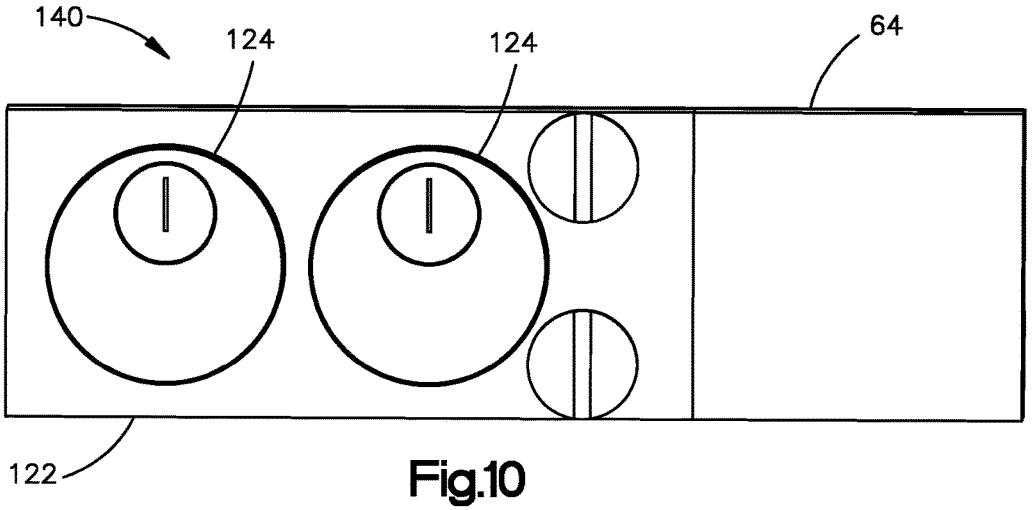
FIG. 10 is a top view of an alternative locking mechanism.

When the lock bolt 124 is moved from the retracted position to the extended position, it moves toward and against the forward edge surface 102 of the latch 100. As the lock bolt 124 advances against the forward edge surface 102 against the bias of the spring 106, it moves the latch 100 pivotally about the second axis 81 from the unlocked position to a locked position. When the latch 100 is in the locked position, the lower end portion 104 of the latch 100 projects outward through the slot 65 in the base plate 62 as shown in FIG. 9, and projects further through the aligned aperture 67 in the door 14 as shown in FIG. 4. The lower end portion 104 of the latch 100 then projects into the path of movement of the plate 40 to block the plate 40 from moving into the ON position. When the lock bolt 124 is subsequently returned to the retracted position by turning the key 130, the spring 106 returns the latch 100 to the unlocked position. Other embodiments may include interlocks 140 with redundancy provided by multiple lock cylinders 124 and keys 130, as shown for example in FIG. 10.

This written description sets for the best mode of carrying out the invention, and describes the invention so as to enable a person of ordinary skill in the art to make and use the invention, by presenting examples of the elements recited in the claims. The detailed descriptions of those examples do not impose limitations that are not recited in the claims, either literally or under the doctrine of equivalents.

What is claimed is:

1. An apparatus for use with a circuit interrupting apparatus shiftable between ON and OFF conditions, the apparatus comprising:

a cabinet configured to contain the circuit interrupting apparatus and having a door with an inner side, an outer side, and an aperture;

a plate mounted on the inner side of the door for movement between ON and OFF positions, and configured to shift the circuit interrupting apparatus between the ON and OFF conditions upon movement of the plate between the ON and OFF positions;

a handle supported on the outer side of the door and linked with the plate to move the plate between the ON and OFF positions upon movement of the handle between corresponding ON and OFF positions;

a latch supported on the outer side of the door for movement through the aperture into and out of a locked position blocking movement of the plate into the ON position;

a spring supported on the outer side of the door in a condition biasing the latch out of the locked position;

a driving member supported on the outer side of the door for movement against the latch to move the latch into the locking position against the bias of the spring; and a key configured to move the driving member against the latch.

2. An apparatus as defined in claim 1 wherein the driving member is a lock bolt in an interlock device.

3. An apparatus as defined in claim 2 wherein the interlock device includes multiple lock cylinders for moving the lock bolt between retracted and extended positions.

4. An apparatus as defined in claim 1 wherein the latch is supported for movement between a locked position in which the latch projects through the aperture and an unlocked position in which the latch does not project through the aperture.

5. An apparatus as define in claim 4 wherein the spring retains the latch in the unlocked position when the handle is in the OFF position.

6. An apparatus as defined in claim 1 wherein the latch is supported for movement pivotally into and out of the locked position.

7. An apparatus as defined in claim 6 wherein the latch has an end portion that projects through the aperture in the door when the latch is in the locked position, has an opposite end portion with an axis of rotation on the outer side of the door.

8. An apparatus as defined in claim 1 wherein the latch has an edge reaching between the end portions of the latch, and the driving member is supported for movement against the latch at the edge of the latch.

9. An apparatus as defined in claim 1 wherein the latch has an axis of rotation, and the driving member is a bolt supported for movement along an axis orthogonal to the rotational axis of the latch.

10. An apparatus as defined in claim 9 further comprising a housing in which the latch is supported on the axis of rotation.

11. An apparatus as defined in claim 10 wherein the housing is mounted over the aperture in the door.

12. An apparatus comprising:

a cabinet having a door with an inner side, an outer side, and an aperture;

a circuit interrupting apparatus installed within the cabinet and shiftable between ON and OFF conditions;

a plate mounted on the inner side of the door for movement between ON and OFF positions, and configured to shift the circuit interrupting apparatus between the ON and OFF conditions upon movement of the plate between the ON and OFF positions;

a handle supported on the outer side of the door and linked with the plate to move the plate between the ON and OFF positions upon movement of the handle between corresponding ON and OFF positions;

a latch supported on the outer side of the door for movement through the aperture into and out of a locked position blocking movement of the plate into the ON position;

a spring supported on the outer side of the door in a condition biasing the latch out of the locked position;

a driving member supported on the outer side of the door for movement against the latch to move the latch into the locking position against the bias of the spring; and a key configured to move the driving member against the latch.

13. An apparatus as defined in claim 12 wherein the driving member is a lock bolt in an interlock device.

14. An apparatus as defined in claim 13 wherein the interlock device includes multiple lock cylinders for moving the lock bolt between retracted and extended positions.

15. An apparatus as defined in claim 12 wherein the latch is supported for movement between a locked position in which the latch projects through the aperture and an unlocked position in which the latch does not project through the aperture.

16. An apparatus as defined in claim 15 wherein the spring retains the latch in the unlocked position when the handle is in the OFF position.

17. An apparatus as defined in claim 12 wherein the latch is supported for movement pivotally into and out of the locked position.

18. An apparatus as defined in claim 17 wherein the latch has an end portion that projects through the aperture in the door when the latch is in the locked position, has an opposite end portion with an axis of rotation on the outer side of the door.

19. An apparatus as defined in claim 12 wherein the latch has an edge reaching between the end portions of the latch, and the driving member is supported for movement against the latch at the edge of the latch.

20. An apparatus as defined in claim 12 wherein the latch has an axis of rotation, and the driving member is a bolt supported for movement along an axis orthogonal to the rotational axis of the latch.

* * * * *